United States Patent [19]

Callen

[11] Patent Number: 4,560,918

[45] Date of Patent: Dec. 24, 1985

[54] HIGH-EFFICIENCY, LOW-VOLTAGE-DROP SERIES REGULATOR USING AS ITS PASS ELEMENT AN ENHANCEMENT-MODE FET WITH BOOSTED GATE VOLTAGE

[75] Inventor: Patrick J. Callen, Yardley, Pa.

[73] Assignee: RCA Corporation, Princeton, N.J.

[21] Appl. No.: 595,932

[22] Filed: Apr. 2, 1984

[51] Int. Cl.[4] ..... G05F 1/56

[52] U.S. Cl. ..... 323/273; 323/268; 323/281

[58] Field of Search ..... 323/266, 268, 273, 279, 323/281, 222, 224, 906

[56] References Cited

U.S. PATENT DOCUMENTS 2,984,779 5/1961 Klees ..... 323/273
4,291,266 9/1981 Portmann ..... 322/906

FOREIGN PATENT DOCUMENTS 2118428 10/1972 Fed. Rep. of Germany ..... 323/281

OTHER PUBLICATIONS

Chetty et al., "DC-DC Power Supply Regulates Down to 0 Volt," Electronics, vol. 51, No. 2, p. 111 (U.S.A.), (Jan. 19, 1978).

M. A. Wyatt, "JFET Minimizes Regulator Differential, Extends Battery Life, Electr. Design, vol. 28, No. 24, pp. 302, 304 (USA) (Nov. 22, 1980).

Prasad, "MOS Power FET Make Excellent Voltage Regulators," Electr. Eng., vol. 51, No. 61, p. 23 (USA) (Feb. 1979).

Tang, "Discrete Regulators Design Regulates Close to Supply Bus," Electr. Design, vol. 28, No. 16, p. 102 (USA), (Aug. 2, 1980).

*Primary Examiner*—William H. Beha, Jr.

*Attorney, Agent, or Firm*—Joseph S. Tripoli; George E. Haas; Allen LeRoy Limberg

[57] ABSTRACT

A highly efficient series regulator for use where output voltage may closely approach input voltage uses the channel of a field effect transistor as a series voltage-dropping element. The conduction of the channel of the field effect transistor is controlled without consumption of appreciable power in the control circuitry for the transistor. Presently available power field effect transistors are of p-channel enhancement mode type. Their threshold voltages are sufficiently high as to make difficult the closing a d.c. feedback loop as will allow output voltage to approach closely input voltage. This problem of closing the d.c. feedback loop is overcome by using voltage boost circuitry, powered from the input voltage supply to the regulator, against which to refer the error signal applied to the gate electrode of the field effect transistor.

1 Claim, 3 Drawing Figures

HIGH-EFFICIENCY, LOW-VOLTAGE-DROP SERIES REGULATOR USING AS ITS PASS ELEMENT AN ENHANCEMENT-MODE FET WITH BOOSTED GATE VOLTAGE

FIELD OF INVENTION

The present invention relates to series voltage or current regulators and, more particularly, to those in which high efficiency and the ability of output voltage to closely approach the direct component of input voltage are of concern.

BACKGROUND OF THE INVENTION

Such a series current regulator is, for example, of interest in controlling the rate of charging of the battery of power cells from a solar array in a space vehicle, where the end-of-charge battery voltage closely approaches the voltage supplied from the solar cell array. Such a series voltage regulator is, for example, of interest following a switching voltage regulator to suppress remnant switching ripple and audio-frequency noise.

The efficiency of a regulator is determined by the ratio of the power it delivers to the power it receives, percent efficiency being one-hundred times that ratio. Series regulation, as opposed to shunt regulation, tends to be more efficient. This is especially so as the difference between regulator input and output voltages becomes increasing less than output voltage.

In a series regulator wherein the difference between input and output voltages is substantially less than output voltage, a substantial portion of its inefficiency can be attributable to power consumed in implementing the control of conduction through the series-pass element that is used to provide the controlled voltage drop between regulator input and output voltages. A bipolar transistor having its collector/emitter path used as a series-pass element requires base current for control, tending towards considerable power consumption in the base current drive circuitry. A series-pass element provided by Darlington connection of bipolar silicon power transistors will require proportionally less control current, but cannot regulate regulator output voltage closer than a volt or so to regulator input voltage. A punch-through or super-beta bipolar silicon power transistor used as series-pass element also has proportionally less control current, but is susceptible to punchthrough of regulator input voltage transient spikes and possible damage therefrom.

Using the channel of a field effect transistor as the series-pass element in a series regulator is advantageous, from the standpoint of regulator efficiency, in that the gate electrode consumes no steady-state power. This is so even where the current flow through the series-pass element is in the several ampere range, reaching up to levels where the channels of a plurality of power FET's have to be parallelled to provide the series pass element. Power FET's of such current handling capability presently available are vertical-structure devices and are only of n-channel enhancement-mode type. Gate cut-off voltage is one volt or more, and typically is several volts.

Where output voltage approaches the input voltage in a series regulator using the channel of such an enhancement-mode power FET in its series-pass element, the gate voltage required to place the channel well into conduction will substantially exceed the input voltage to, and output voltage from, the regulator.

SUMMARY OF THE INVENTION

The present invention is embodied in a series regulator using the channel of an FET in its series-pass element, in which regulator the output voltage approaches the average of its input voltage. An error signal voltage is generated responsive to the difference of its output level from a prescribed value and is applied to the gate electrode of the FET. The error signal voltage is developed with reference to a voltage generated by boost from the regulator input voltage.

DETAILED DESCRIPTION

Figure 1:
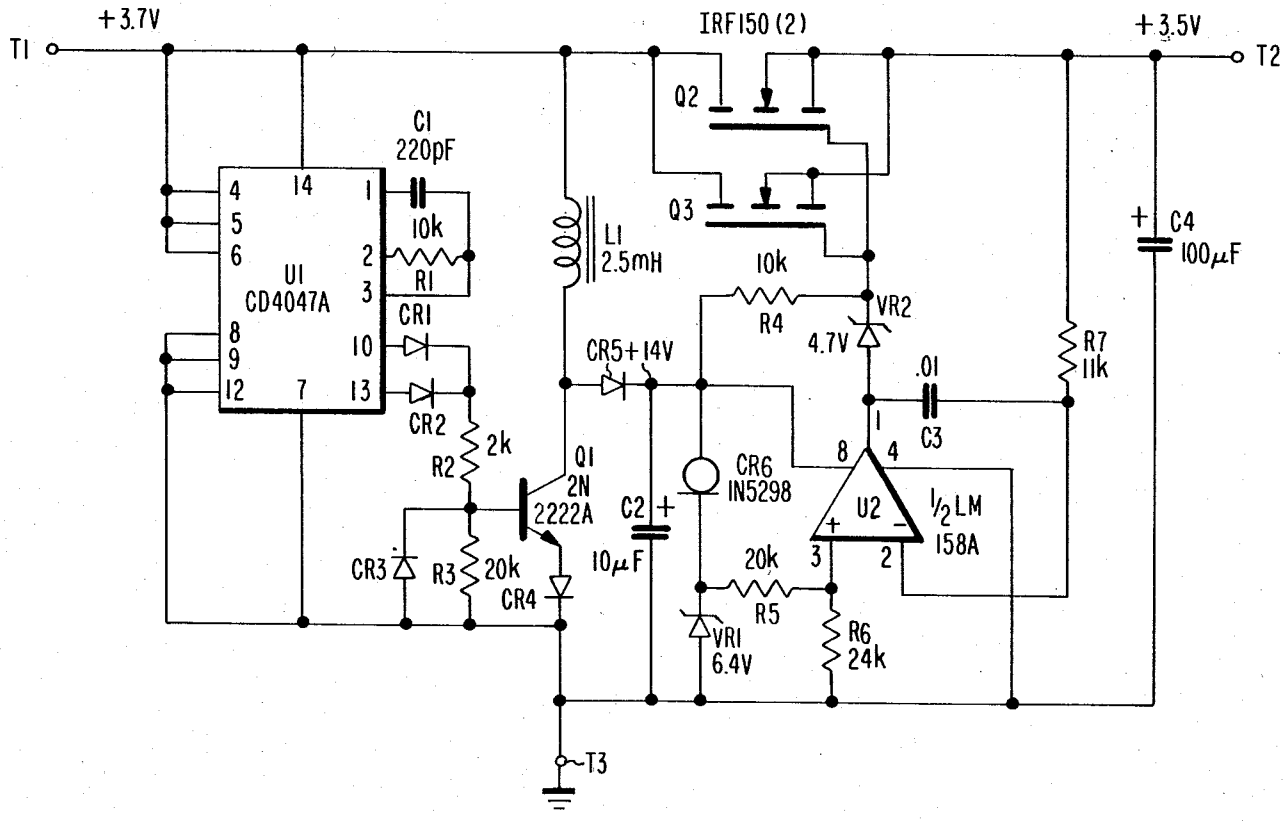
FIG. 1 is a schematic diagram of a series voltage regulator embodying the present invention in which the output voltage is regulated within 0.2 volts of a 3.7 volt input voltage.

In FIG. 1 series regulator, terminals T1, T2, and T3 are the input voltage, output voltage and common terminals respectively. The series-pass element connecting input terminal T1 to output terminal T2 comprises the parallelled channels of two n-channel hex-FET's of the IRF 150 type manufactured by International Rectifier Corp., which have gate electrodes connected together at a control node. An error signal voltage is applied to this node from the cathode of a voltage reference diode VR2.

To maintain VR2 in reverse breakdown conduction, it is supplied current via a resistor R4 with one of its ends at the interconnected gate electrodes of Q2 and Q3 and with the other of its ends connected to receive a 14 volt boosted input voltage, substantially larger than the 3.7 volt input voltage applied between the common terminal T3 and input voltage terminal T1 of the FIG. 1 regulator. This 14 volt boosted input voltage is developed using a current rectifier CR5 as series switch and a capacitor C2 as shunt charge storage element, for detecting the positive excursions of flyback voltage supplied by ringing inductor L1 at the one of its ends remote from the end connected to regulator input terminal T1 to receive the 3.7 volts regulator input voltage. The flyback intervals are interspersed with the end of inductor L1 remote from T1 being clamped to common terminal T3 by conduction of the collector-to-emitter path of NPN transistor Q1 and concurrent conduction of current rectifier CR4 in Q1 emitter connection to T3. The duty cycle for conduction in Q1 is about 75% as determined by rectangular wave drive applied to its base electrode, so the flyback voltage developed across inductor $L_1$ when Q1 is non-conductive is substantially four times the voltage applied across $L_1$ when Q1 is conductive, in satisfaction of Lenz's Law. The rectangular wave applied to the base electrode of Q1 by potential division using resistors R2, R3 is developed by current rectifiers CR1 and CR2 ORing the outputs of an astable multivibrator. The astable multivibrator, powered from the source (not shown) of input voltage applied between regulator terminals T3 and T1, comprises a CMOS integrated circuit U1 (the CD 4047A manufactured by RCA Corporation), a timing resistor R1, and a timing capacitor C1. The RC time constant of timing resistor R1 and timing capacitor C2 sets an 87 KHz repetition rate for the 75% duty factor rectangular wave controlling Q1 conduction. The offset voltage across current rectifier CR4 when it is conditioned for forward conduction causes the switching of Q1 into conduction to occur more in midrange of the rectangular voltage waveform applied to its base. Current rectifier CR3 is a base protection diode for Q1.

The error signal applied to the gate electrodes of Q2, Q3 is developed at the cathode of the voltage reference diode VR2, maintained in reverse conduction by currrent flowing thereto via resistor R4. Voltage reference diode VR2 applies to the gate electrodes of Q2, Q3 with a 4.7 volt offset the output voltage of an operational amplifier U2, as applied to its anode. U2 is shown as half the monolithically integrated LM 158A dual operational amplifier manufactured by National Semiconductor. U2 is shown receiving operating power from the +14 volt boosted input voltage.

The non-inverting input voltage applied to operational amplifier U2 is obtained by dividing the 6.4 volt potential developed across a voltage reference diode VR1. VR1 is biased into avalanche conduction by its connection to +14 volt boosted input voltage via a constant current generator CR6. The 6.4 volts developed across avalanched VR1 is divided by resistors R5 and R6 to apply 3.5 volts to the non-inverting input connection of operational amplifier U2.

The regulator output voltage at terminal T2 is applied via resistor R7 to the inverting input connection of operational amplifier U2. This closes the degenerative feedback loop operative to generate error signal at the gate electrodes of Q2, Q3. This error signal adjusts the conduction of Q2, Q3 so the voltage drop across their channels places the voltage at terminal T2, applied to operational amplifier U2 inverting input connection, close to the 3.5 volts applied to operational amplifier U2 non-inverting input connection. Capacitor C3 connected between the output and inverting input connections of operational amplifier U2 stabilizes the loop against self regeneration at high frequencies. Capacitor C4 shunting the output terminal T2 to common terminal T3 operates as a smoothing capacitor.

Figure 2:
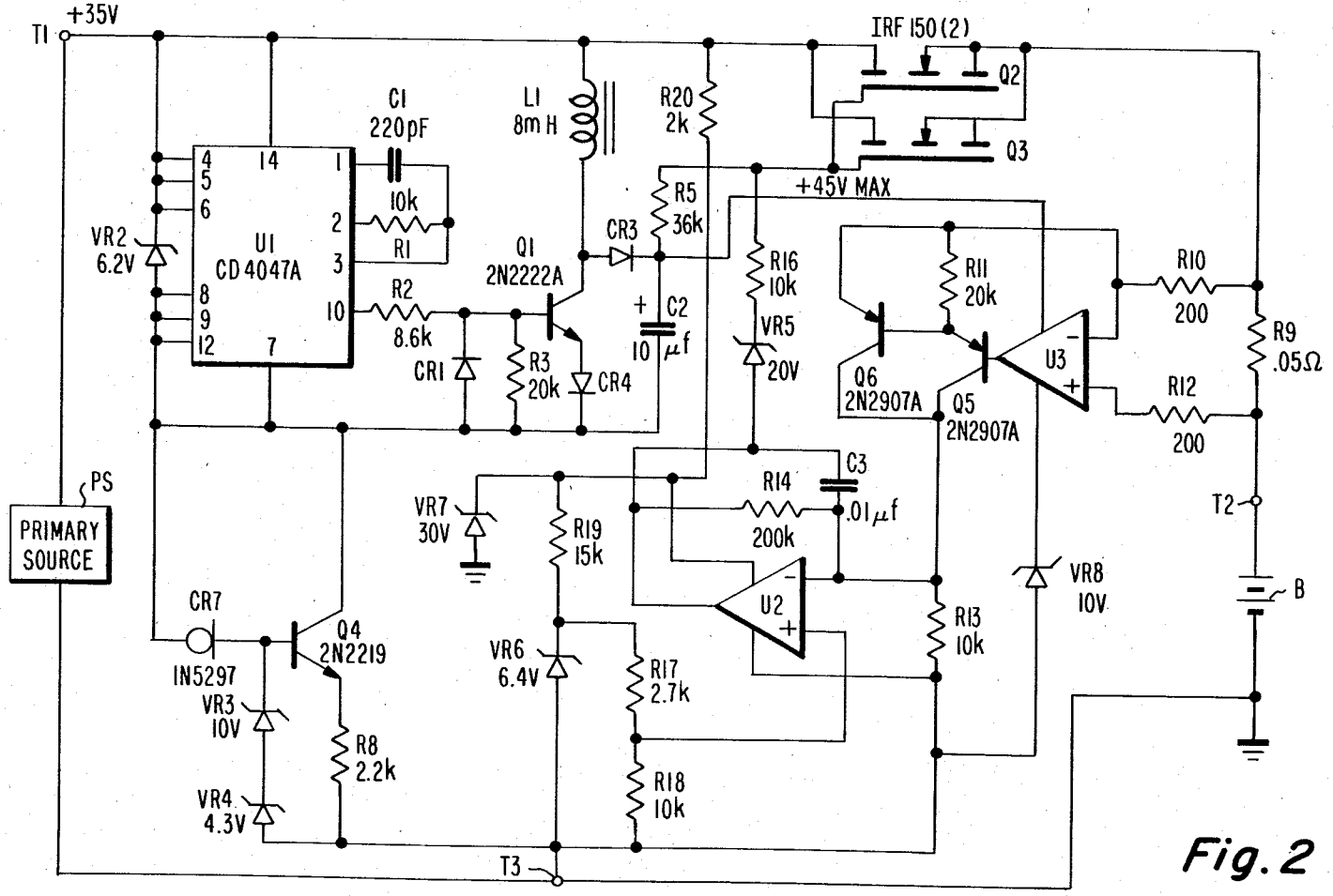
FIG. 2 is a schematic diagram of a series current regulator embodying the present invention, shown used to control the rate of charge to a battery of power cells with end-of-charge voltage close to the voltage of the primary source of charging current.

FIG. 2 shows modifications of the FIG. 1 series voltage regulator to provide a series current regulator. Such a series current regulator is useful, for example, in regulating the charging current supplied from a primary source PS (connected between terminals T3 and T1) to a battery B of power cells (connected between terminals T3 and T2). The input voltage supplied by the primary source PS is 45 volts, high in comparison to the operating voltage desired for astable multivibrator integrated circuit U1. So operating current is drawn through U1 by constant current generator connection of n-p-n transistor Q4, and the operating voltage of U1 is shunt-regulated by a voltage-reference diode VR2 poled for avalanche conduction in parallel with U1. Q4 is conditioned for constant current generation at its collector by applying the combined avalanche voltages of voltage reference diodes VR3 and VR4 across the series connection of Q4 base-emitter junction and an emitter degeneration resistor R8. The series connection of VR3 and VR4 is biased into avalanche by current flow through a constant current generator diode CR7, which constant current is added to the constant collector current flow of Q4 through the parallel connection of VR2 and astable U1.

A high-conductance resistor R9 is inserted between output terminal T2 and the series-pass element provided by the parallelled channels of transistors Q2, Q3, for current sensing purposes. The combined emitter currents of p-n-p transistors Q5 and Q6 flowing through resistor R10 develop a potential drop therethrough. The difference between this potential drop and the potential drop across R9 owing to regulator output current is applied as input offset voltage between the inverting and non-inverting input connections of an operational amplifier U3, which may be the other half of the LM 158 used for U2. The output connection of operational amplifier U3 is to the base of p-n-p transistor Q5 having an emitter resistor R11 across the emitter-base junction of p-n-p transistor Q6. This completes the degenerative feedback loop for regulating the combined emitter currents of Q5 and Q6 to be reduced to the regulator output current flowing through R9, ratioing them in the same ratio as the conductances of R10 and R9. Connection to the non-inverting connection of operational amplifier U3 is through a resistor R12 of like resistance as R10 so the incremental voltage drop across R10 due to U3 inverting input current is compensated by the voltage drop across R12 due to U3 non-inverting input current. The combined collector currents of Q5 and Q6 substantially equal their combined emitter currents and thus continuously measure the regulator output current.

In FIG. 2 current regulator, error signal is developed by a current-to-voltage conversion process with the voltage resulting from the conversion being superposed on a direct bias potential. Resistor R14 connects between the output and inverting output connections of operational amplifier U2 and forms a potential divider with R13, completing a local degenerative feedback loop. If there were no current flow from the collectors of Q5 and Q6 through R13, this loop would regulate operational amplifier U2 output connection to a voltage which is larger than the fixed potential applied to U2 non-inverting input connection, being larger by a factor equal to the ratio of R14 resistance to R13 resistance. This voltage at the output connection of operational amplifier U2, as translated upward 20 volts by the offset voltage across a voltage reference diode VR5, supplies one end of a resistive voltage divider. This divider has its other end connected to boosted input voltage and comprises resistors R15 and R16 in series connection, to provide at their interconnection the quiescent bias voltage to the gate electrodes of FET's Q2 and Q3.

As charge current is drawn through current-sensing resistor R9, preceding output terminal T2 in FIG. 2, a proportional current is supplied by the collectors of p-n-p transistors Q5 and Q6 to flow through R13. This reduces the current flow required to be supplied to R13 via R14 in the local degenerative feedback loop around operational amplifier U2, in order that the inverting and non-inverting input voltages of U2 be substantially equal. So the local feedback reduces the output voltage of operational amplifier U2 as applied via voltage-translating voltage reference diode VR5 and the voltage divider comprising R15 and R16, this error signal lowers the gate potential of FET's Q2 and Q3 with respect to their source potential. The conduction of Q2 and Q3 channels are accordingly reduced to regulate output current flow.

As the output current reaches the value it is intended to be regulated to, the voltage at the output connection of operational amplifier U2 is reduced towards the voltage at its inverting input connection, curtailing the flow of current through R14 to R13. So, the current flow through R13 is in substantial measure supplied by the combined collector of Q5 and Q6 to cause the voltage drop there across substantially equal to the 5.0 volts applied to the non-inverting input terminal of operational amplifier U2. This current level of 500 microamperes as scaled by four-thousand the ratio of the conductances of R9 and R10, corresponds to about 2.0 ampere charge to battery B.

The 5.0 volts applied to the non-inverting terminal of operational amplifier U2 is provided at the interconnection of resistors R17 and R18 of a potential divider for the 6.4 volts potential maintained across a voltage reference diode VR6. VR6 is kept in avalanche by current supplied from a 30 volt supply via bleeder resistor R19. The 30 volt supply, which supplies operating voltage and current to operational amplifier U2, is shunregulated by voltage reference diode VR7 kept in avalanche by current supplied from primary source PS via input terminal T1 and bleeder resistor R20. Operational amplifier U3 receives boosted input voltage as positive operating voltage, and its negative operating voltage is established by its operating current flowing to avalanche voltage reference diode VR8. Only one output signal of astable U1 is used in the FIG. 2 regulator, to switch Q1 base with a 50% duty cycle square wave.

Figure 3:
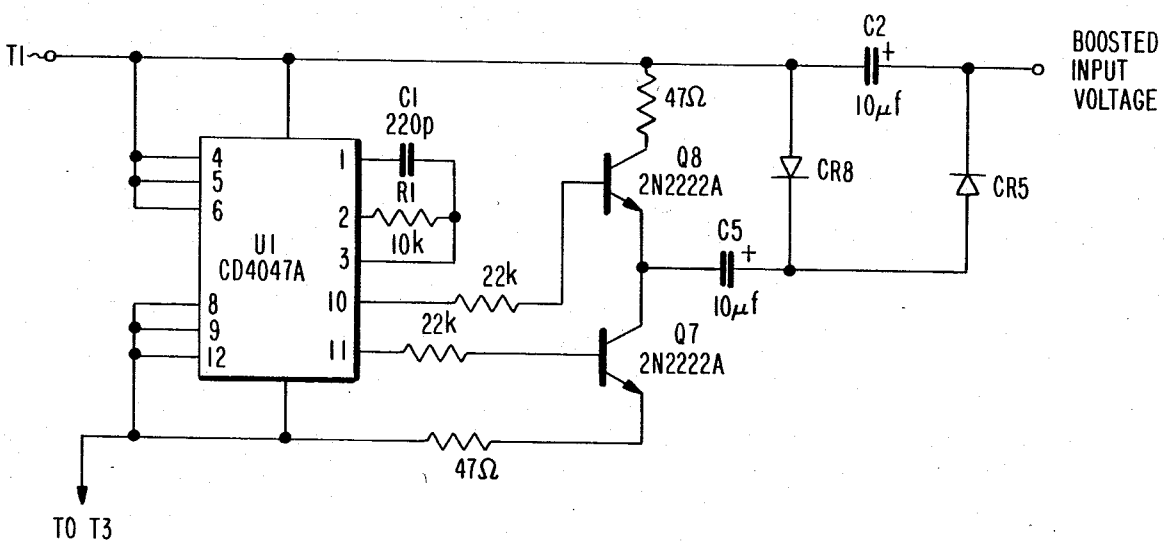
FIG. 3 is a schematic diagram of an alternative type of voltage boost circuit as may be employed in either of the FIG. 1 or FIG. 2 regulators, for providing further embodiments of the invention.

FIG. 3 shows an alternative input voltage boost circuit, using a Greinacher type of voltage multiplier, which can replace the flyback transformer voltage boost circuit. Push-pull square-wave output voltages from the astable U1 are applied to the base electrodes of transistors Q7 and Q8 to alternately switch them into conduction. When Q7 conducts, current rectifier CR8 is drawn into conduction and C5 charges to U1 operating voltage, while current rectifier CR5 is non-conductive. When Q8 conducts the voltage on capacitor C5 is boosted and peak rectified by CR5, C2. As known additional stages of voltage multiplication can be used, if needed.

What is claimed is:

1. A series regulator comprising:

common and input terminals for receiving an applied input voltage;

an output terminal for supplying an output level which is to be regulated to a prescribed value;

at least one field effect transistor, having a channel connected between said input and output terminals, and having a gate electrode between which and said common terminal a voltage must appear that is larger than said input voltage applied between said input terminal and said common terminal, in order to control the conduction of said channel as output voltage approaches the input voltage in value, which gate electrode connects to a control voltage node;

a voltage boost circuit for developing from the input voltage appearing between said common and input terminals a larger voltage as referred to said common terminal;

means responsive to the amount said output level exceeds said prescribed value therefor for developing said error signal voltage as a voltage drop from said larger voltage; and means for applying said error signal voltage to said control voltage node.

* * * * *